US011149557B2

(12) United States Patent
Lee

(10) Patent No.: US 11,149,557 B2
(45) Date of Patent: Oct. 19, 2021

(54) TURBINE VANE, RING SEGMENT, AND GAS TURBINE INCLUDING THE SAME

(71) Applicant: DOOSAN HEAVY INDUSTRIES & CONSTRUCTION CO., LTD., Changwon-si (KR)

(72) Inventor: Chang Yong Lee, Sejong-si (KR)

( * ) Notice: Subject to any disclaimer, the term of this patent is extended or adjusted under 35 U.S.C. 154(b) by 203 days.

(21) Appl. No.: 16/543,390

(22) Filed: Aug. 16, 2019

(65) Prior Publication Data

US 2020/0131914 A1 Apr. 30, 2020

(30) Foreign Application Priority Data

Oct. 29, 2018 (KR) ..... 10-2018-0129531

(51) Int. Cl.
*F01D 5/18* (2006.01)

(52) U.S. Cl.
CPC ..... *F01D 5/189* (2013.01); *F01D 5/186* (2013.01); *F05D 2220/32* (2013.01); *F05D 2240/12* (2013.01); *F05D 2260/201* (2013.01); *F05D 2260/202* (2013.01)

(58) Field of Classification Search
CPC ..... F01D 5/189; F01D 5/186; F01D 5/188; F05D 2240/126
See application file for complete search history.

(56) References Cited

U.S. PATENT DOCUMENTS

| | | | | |
|---|---|---|---|---|
| 4,064,300 | A * | 12/1977 | Bhangu | F23R 3/002 428/120 |
| 4,105,364 | A * | 8/1978 | Dodd | F01D 5/189 416/97 R |
| 4,446,693 | A * | 5/1984 | Pidcock | F23R 3/002 60/757 |
| 7,300,251 | B2 * | 11/2007 | Kitamura | F01D 5/189 416/97 R |
| 7,938,624 | B2 * | 5/2011 | Tibbott | F23R 3/002 416/96 R |
| 8,444,376 | B2 | 5/2013 | Krueckels et al. | |
| 8,668,453 | B2 * | 3/2014 | Lee | F01D 5/187 416/96 R |
| 9,988,913 | B2 * | 6/2018 | Spangler | F01D 5/284 |
| 10,968,755 | B2 * | 4/2021 | Bang | F01D 5/188 |
| 2006/0210399 | A1 * | 9/2006 | Kitamura | F01D 5/189 416/97 R |

(Continued)

FOREIGN PATENT DOCUMENTS

| | | | |
|---|---|---|---|
| JP | 2010-174688 | A | 8/2010 |
| KR | 10-2005-0096604 | A | 10/2005 |

(Continued)

*Primary Examiner* — Eldon T Brockman
(74) *Attorney, Agent, or Firm* — Harvest IP Law, LLP

(57) ABSTRACT

A turbine vane is provided. The turbine vane may include a sidewall configured to form an airfoil including a leading edge and a trailing edge, an insert configured to be inserted inside the sidewall such that a gap is formed between the insert and an inner surface of the sidewall and include a plurality of insert holes, and a plurality of guides extending from the sidewall and configured to guide a flow of cooling fluid through the gap, wherein the plurality of guides guide cooling fluid drawn through the insert holes to prevent the cooling fluid from interfering with a flow of cooling fluid drawn through a subsequent insert hole.

14 Claims, 11 Drawing Sheets

(56) References Cited

U.S. PATENT DOCUMENTS

| | | | | |
|---|---|---|---|---|
| 2008/0063524 | A1* | 3/2008 | Tibbott | F01D 5/187<br>416/95 |
| 2016/0333735 | A1* | 11/2016 | Bunker | F01D 9/023 |
| 2017/0058679 | A1* | 3/2017 | Spangler | B23P 15/02 |
| 2018/0163545 | A1* | 6/2018 | Bang | F01D 5/187 |

FOREIGN PATENT DOCUMENTS

| | | | |
|---|---|---|---|
| KR | 10-2018-0065728 | A | 6/2018 |
| KR | 2018-0065728 | A | 6/2018 |

* cited by examiner

TURBINE VANE, RING SEGMENT, AND GAS TURBINE INCLUDING THE SAME

CROSS-REFERENCE TO RELATED APPLICATION

This application claims priority to Korean Patent Application No. 10-2018-0129531, filed on Oct. 29, 2018, the disclosure of which is incorporated herein by reference in its entirety.

BACKGROUND

Field

Apparatuses and methods consistent with exemplary embodiments relate to a turbine vane, a ring segment, and a gas turbine including the same.

Description of the Related Art

A turbine is a machine which generates rotating force from impulsive force or reaction force using a flow of compressive fluid such as steam or gas. The turbine is classified into a steam turbine using steam, a gas turbine using high-temperature combustion gas, and so forth.

The gas turbine includes a compressor, a combustor, and a turbine. The compressor includes an air inlet into which air is introduced, and a plurality of compressor vanes and a plurality of compressor blades which are alternately provided in a compressor housing.

The combustor is configured to supply fuel into air compressed by the compressor and ignite the fuel mixture using a burner to generate high-temperature and high-pressure combustion gas.

The turbine includes a plurality of turbine vanes and a plurality of turbine blades which are alternately arranged in a turbine housing. Furthermore, a rotor is disposed passing through central portions of the compressor, the combustor, the turbine, and an exhaust chamber.

The rotor is rotatably supported at both ends thereof by bearings. A plurality of disks are fixed to the rotor, and the plurality of blades are coupled to corresponding disks, respectively. A driving shaft of a generator is coupled to an end of the rotor that is adjacent to the exhaust chamber.

A gas turbine does not have a reciprocating component such as a piston which is usually provided in a four-stroke engine. That is, the gas turbine has no mutual friction parts such as a piston-and-cylinder, thereby having advantages in that there is little consumption of lubricant, and an amplitude of vibration is markedly reduced unlike a reciprocating machine having high-amplitude characteristics. Therefore, high-speed driving is possible.

A brief description of the operation of the gas turbine is as follows. Air compressed by the compressor is mixed with fuel, the fuel mixture is combusted to generate high-temperature combustion gas, and the generated combustion gas is discharged to the turbine. The discharged combustion gas passes through the turbine vanes and the turbine blades and generates rotating force by which the rotor is rotated.

SUMMARY

Aspects of one or more exemplary embodiments provide a turbine vane including a guide structure capable of preventing a gap flow flowing in a gap between a sidewall of the turbine vane and an insert and an impingement jet drawn through an insert hole or a cooling hole from interfering with each other, whereby the cooling performance may be enhanced.

Aspects of one or more exemplary embodiments provide a turbine vane or a turbine ring segment including a guide structure to prevent a gap flow flowing in a gap between a thin plate and a bottom surface of a concave part of an endwall or a turbine ring segment of the turbine vane and an impingement jet drawn through a cooling hole from interfering with each other.

Additional aspects will be set forth in part in the description which follows and, in part, will become apparent from the description, or may be learned by practice of the exemplary embodiments.

According to an aspect of an exemplary embodiment, there is provided a turbine vane including: a sidewall configured to form an airfoil including a leading edge and a trailing edge; an insert configured to be inserted inside the sidewall such that a gap is formed between the insert and an inner surface of the sidewall and include a plurality of insert holes; and a plurality of guides extending from the sidewall and configured to guide a flow of cooling fluid through the gap, wherein the plurality of guides may guide cooling fluid drawn through the insert holes to prevent the cooling fluid from interfering with a flow of cooling fluid drawn through a subsequent insert hole.

The plurality of guides may contact with a surface of the insert.

The plurality of insert holes may be arranged to form a plurality of rows and a plurality of columns, and insert holes of each of the columns may be arranged to alternate with insert holes of a subsequent column.

Each of the plurality of guides may include an upstream end disposed at an upstream side of a gap flow, a pair of sidewalls disposed to enclose an upstream side part of the insert hole, and downstream ends disposed on respective sidewalls at left and right sides of the insert hole with respect to a gap flow direction.

The plurality of guides may be arranged such that a distance between a downstream end of a guide on each of the rows and a downstream end of a guide on a subsequent row is ⅓ to 3 times a diameter of the insert hole.

The plurality of guides may be arranged such that a distance between an upstream end of a guide on each of the columns and an upstream end of a guide on a subsequent column with respect to the gap flow direction is 3 to 10 times the diameter of the insert hole.

The guide may further include an impingement part integrally coupled to the upstream end and disposed perpendicular to the gap flow direction.

Each of the plurality of guides may include an upstream impingement part disposed at an upstream side of the gap flow so that cooling fluid impinges against the upstream impingement part, a pair of sidewalls extending from upper and lower ends of the upstream impingement part in left and right diagonal directions relative to a gap flow direction of the insert hole and disposed to enclose an upstream side part of the insert hole, and downstream ends disposed on respective sidewalls at left and right sides of the insert hole with respect to the gap flow direction.

The upstream impingement part may have a planar shape.

The upstream impingement part may have a convex or concave curved shape toward an upstream side of the gap flow.

A height of the upstream impingement part may be 1.5 to 3 times a height of a pair of sidewalls.

According to an aspect of another exemplary embodiment, there is provided a turbine vane including: endwalls configured to be coupled to an inner end and an outer end of the turbine vane; a concave part configured to be formed on a body part of the endwall at a side opposite to the turbine vane and include a plurality of cooling holes; a thin plate coupled to the concave part such that a gap is formed between the thin plate and a bottom surface of the concave part; and a plurality of guides extending from the bottom surface of the concave part and configured to guide a flow of cooling fluid through the gap, wherein the plurality of guides guide cooling fluid drawn through the cooling holes to prevent the cooling fluid from interfering with a flow of cooling fluid drawn through a subsequent cooling hole, wherein the plurality of cooling holes are arranged to form a plurality of rows and columns, and wherein cooling holes of each of the columns are arrange to alternate cooling holes of a subsequent column.

Each of the plurality of guides may include an upstream impingement part disposed at an upstream side of the gap flow so that cooling fluid impinges against the upstream impingement part, a pair of sidewalls extending from upper and lower ends of the upstream impingement part in left and right diagonal directions relative to a gap flow direction of the insert hole and disposed to enclose an upstream side part of the insert hole, and downstream ends disposed on respective sidewalls at left and right sides of the insert hole with respect to the gap flow direction.

The plurality of guides may be arranged such that a distance between a downstream end of a guide on each of the rows and a downstream end of a guide on a subsequent row is ⅓ to 3 times a diameter of the insert hole.

A height of the upstream impingement part may be 1.5 to 3 times a height of a pair of sidewalls.

According to an aspect of another exemplary embodiment, there is provided a ring segment including: a ring segment body disposed to enclose a turbine blade and mounted to an inner circumferential surface of a turbine casing; a concave part configured to be formed in the ring segment body at a side opposite to the turbine blade and include a plurality of cooling holes; a thin plate configured to be coupled to the concave part such that a gap is formed between the thin plate and a bottom surface of the concave part; and a plurality of guides extending from the bottom surface of the concave part and configured to guide a flow of cooling fluid through the gap, wherein the plurality of guides guide cooling fluid drawn through the cooling holes to prevent the cooling fluid from interfering with a flow of cooling fluid drawn through a subsequent cooling hole.

The plurality of cooling holes may be arranged to form a plurality of rows and columns, and cooling holes of each of the columns may be arranged to alternate with cooling holes of a subsequent column.

Each of the plurality of guides may include an upstream impingement part disposed at an upstream side of a gap flow so that cooling fluid impinges against the upstream impingement part, a pair of sidewalls extending from upper and lower ends of the upstream impingement part in left and right diagonal directions relative to a gap flow direction of the insert hole and disposed to enclose an upstream side part of the insert hole, and downstream ends disposed on respective sidewalls at left and right sides of the insert hole with respect to the gap flow direction.

The plurality of guides may be arranged such that a distance between a downstream end of a guide on each of the rows and a downstream end of a guide on a subsequent row is ⅓ to 3 times a diameter of the insert hole.

A height of the upstream impingement part may be 1.5 to 3 times a height of a pair of sidewalls.

In accordance with one or more exemplary embodiments, a turbine vane may include a guide structure capable of preventing a gap flow flowing in a gap between a sidewall and an insert or between a concave part and a thin plate and an impingement jet drawn through an insert hole or a cooling hole from interfering with each other. Thereby, the cooling performance may be enhanced.

In accordance with one or more exemplary embodiments, a guide structure is provided to prevent a gap flow flowing in a gap between a thin plate and a bottom surface of a concave part of an endwall or a turbine ring segment of the turbine vane and an impingement jet drawn through a cooling hole from interfering with each other. Thereby, the cooling performance may be enhanced.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
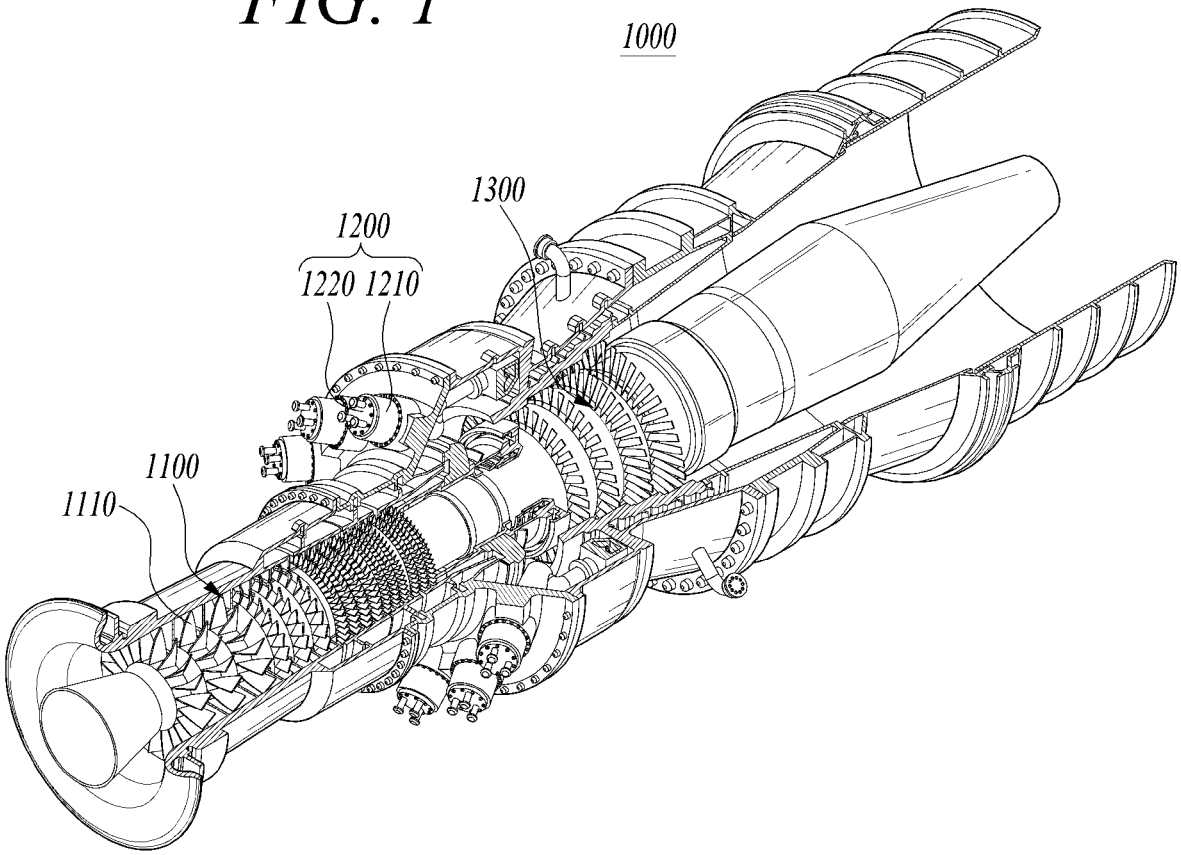
FIG. 1 is a partially exploded perspective view of a gas turbine in accordance with an exemplary embodiment.

Various modifications and various embodiments will be described in detail with reference to the drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well, unless the context clearly indicates otherwise. In the disclosure, the terms such as "comprise", "include", "have/has" should be construed as designating that there are such features, integers, steps, operations, elements, components, and/or combinations thereof, not to exclude the presence or possibility of adding of one or more of other features, integers, steps, operations, elements, components, and/or combinations thereof.

Hereinafter, exemplary embodiments will be described in detail with reference to the accompanying drawings. Reference now should be made to the drawings, in which the same reference numerals are used throughout the different drawings to designate the same or similar components. Details of well-known configurations and functions may be omitted to avoid unnecessarily obscuring the gist of the present disclosure. For the same reason, in the accompanying drawings, some elements are enlarged, omitted, or depicted schematically.

Figure 2:
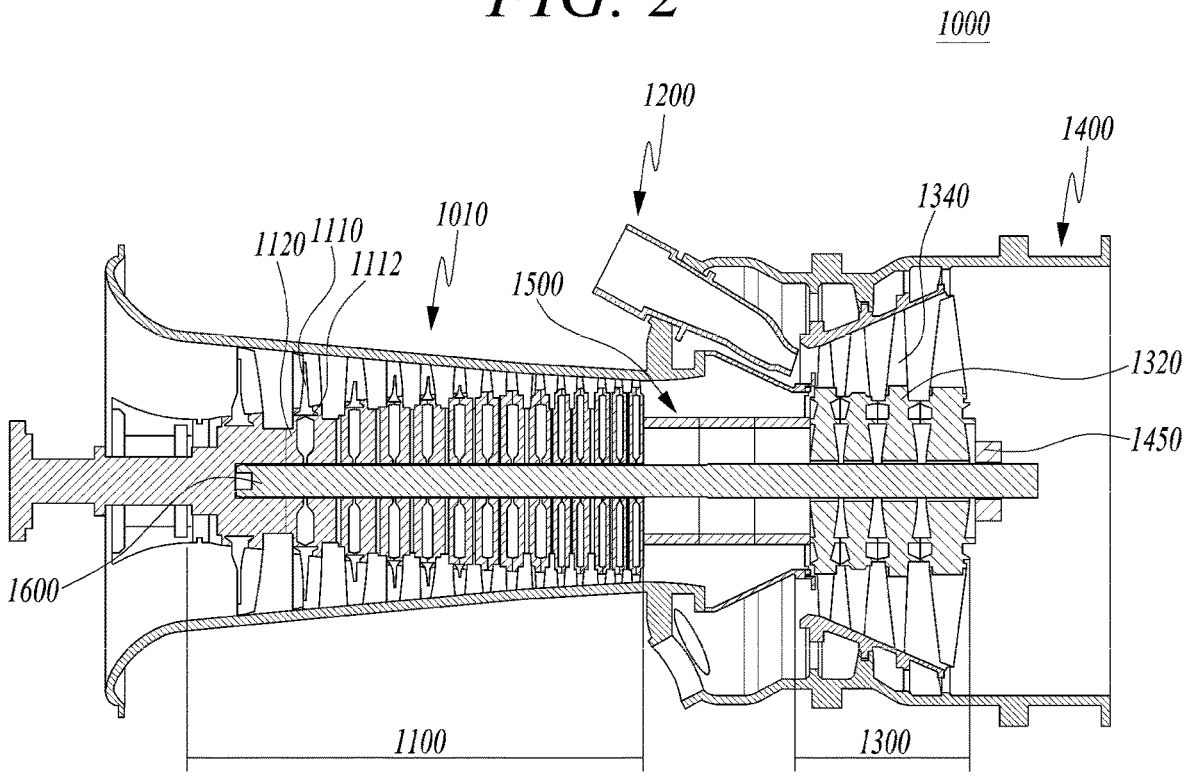
FIG. 2 is a sectional view illustrating a schematic structure of the gas turbine in accordance with an exemplary embodiment.
Figure 3:
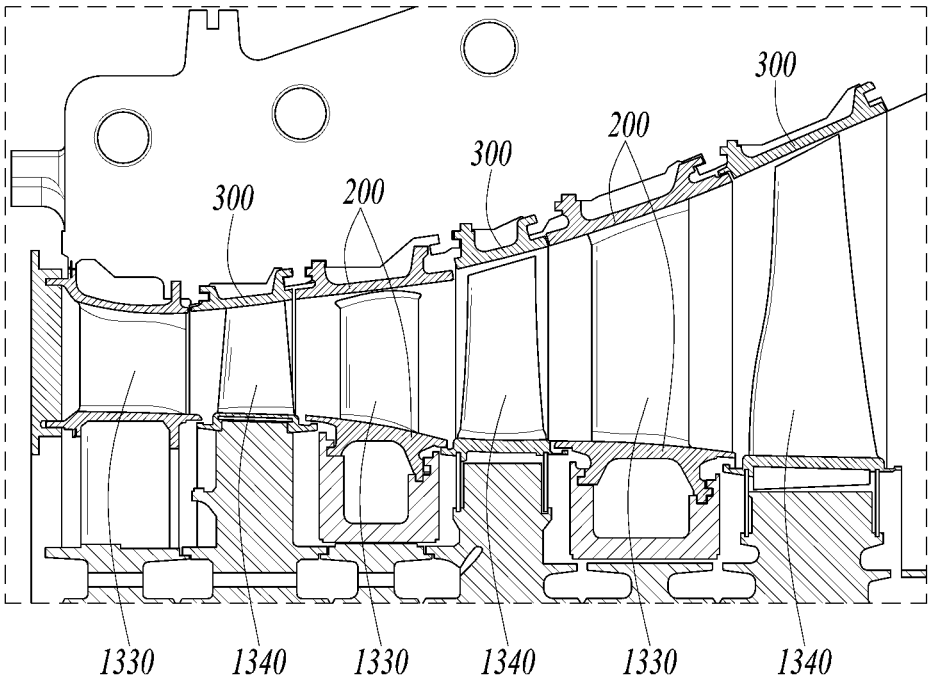
FIG. 3 is a partial sectional view illustrating an internal structure of the gas turbine in accordance with an exemplary embodiment.
Figure 4:
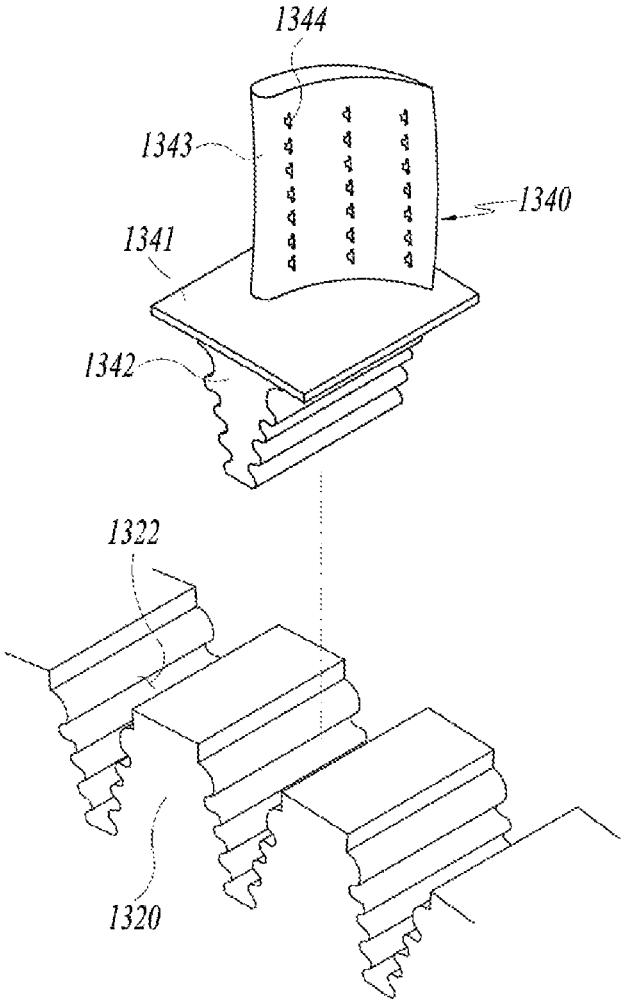
FIG. 4 is an exploded perspective view illustrating a turbine rotor disk of FIG. 2.

FIG. 1 is a partially exploded perspective view of a gas turbine in accordance with an exemplary embodiment, FIG. 2 is a sectional view illustrating a schematic structure of the gas turbine in accordance with an exemplary embodiment, FIG. 3 is a partial sectional view illustrating an internal structure of the gas turbine in accordance with an exemplary embodiment, and FIG. 4 is an exploded perspective view illustrating a turbine rotor disk of FIG. 2.

Referring to FIG. 1, the gas turbine 1000 may include a compressor 1100, a combustor 120, and a turbine 1300. The compressor 1100 includes a plurality of blades 1110 which are radially installed. The compressor 1100 rotates the plurality of blades 1110, and air is compressed and moved by the rotation of the plurality of blades 1110. A size and installation angle of each of the plurality of blades 1110 may be changed depending on an installation position thereof. The compressor 1100 is directly or indirectly coupled with the turbine 1300, and may receive some of power generated from the turbine 1300 and use the received power to rotate the plurality of blades 1110.

Air compressed by the compressor 1100 may be moved to the combustor 1200. The combustor 1200 includes a plurality of combustion chambers 1210 and a plurality of fuel nozzle modules 1220 which are arranged in an annular shape.

Referring to FIG. 2, the gas turbine 1000 may include a housing 1010 and a diffuser 1400 provided behind the housing 1010 to discharge the combustion gas passing through the turbine 1300. The combustor 1200 is disposed in front of the diffuser 1400 to combust the compressed air supplied thereto.

Based on a flow direction of air, the compressor 1100 is disposed at an upstream side, and the turbine 1300 is disposed at a downstream side. In addition, a torque tube 1500 serving as a torque transmission member for transmitting rotational torque generated from the turbine 1300 to the compressor 1100 is disposed between the compressor 1100 and the turbine 1300.

The compressor 1100 includes a plurality of compressor rotor disks 1120, each of which is fastened by a tie rod 1600 to prevent axial separation in an axial direction of the tie rod 1600.

For example, the compressor rotor disks 1120 are aligned with each other along an axial direction in such a way that the tie rod 1600 that forms a rotating shaft passes through central portions of the compressor rotor disks 1120. Here, adjacent compressor rotor disks 1120 are arranged so that facing surfaces thereof are in tight contact with each other by the tie rod 1600. The adjacent compressor rotor disks 1120 cannot rotate relative to each other because of this arrangement.

A plurality of blades 1110 are radially coupled to an outer circumferential surface of each of the compressor rotor disks 1120. Each of the blades 1110 includes a dovetail part 1112 by which the blade 1110 is coupled to the compressor rotor disk 1120.

A plurality of compressor vanes are fixedly arranged between each of the compressor rotor disks 1120. While the compressor rotor disks 1120 rotate along with a rotation of the tie rod 1600, the compressor vanes fixed to the housing 1010 do not rotate. The compressor vanes guide the flow of compressed air moved from front-stage compressor blades 1110 of the compressor rotor disk 1120 to rear-stage compressor blades 1110 of the compressor rotor disk 1120.

A coupling scheme of the dovetail part 1112 is classified into a tangential type and an axial type. This may be selected depending on a structure of the gas turbine to be used, and may have dovetail shape or fir-tree shape. In some cases, the compressor blade 1110 may be coupled to the compressor rotor disk 1120 by using other types of coupling device, such as a key or a bolt.

The tie rod 1600 is disposed passing through central portions of the plurality of compressor rotor disks 1120 and a plurality of turbine rotor disks 1320. The tie rod 1600 may be a single or multi-tie rod structure. One end of the tie rod 1600 is coupled to the compressor rotor disk 1120 that is disposed at the most upstream side, and the other end thereof is coupled with a fastening nut 1450.

It is understood that the shape of the tie rod 1600 is not limited to example illustrated in FIG. 2, and may be changed or vary according to one or more other exemplary embodiments. For example, a single tie rod may be disposed passing through the central portions of the rotor disks, a plurality of tie rods may be arranged in a circumferential direction, or a combination thereof is also possible.

Also, a vane functioning as a guide vane may be installed at the rear stage of the diffuser of the compressor 1100 so as to adjust an actual flow angle of fluid entering into an inlet of the combustor and increase the pressure of the fluid. This vane is referred to as a deswirler.

The combustor 1200 mixes introduced compressed air with fuel, combusts the fuel mixture to generate high-temperature and high-pressure combustion gas having high energy, and increases, through an isobaric combustion process, the temperature of the combustion gas to a temperature at which the combustor and the turbine can endure.

A plurality of combustors constituting the combustor 1200 may be arranged in a housing in a form of a cell. Each of the combustors includes a burner including a fuel injection nozzle, etc., a combustor liner forming a combustion chamber, and a transition piece serving as a connector between the combustor and the turbine.

The combustor liner provides a combustion space in which fuel discharged from the fuel injection nozzle is mixed with compressed air supplied from the compressor and then combusted. The combustor liner may include a flame tube for providing the combustion space in which the fuel mixed with air is combusted, and a flow sleeve for forming an annular space enclosing the flame tube. The fuel injection nozzle is coupled to a front end of the combustor liner, and an ignition plug is coupled to a sidewall of the combustor liner.

The transition piece is connected to a rear end of the combustor liner so as to transfer combustion gas combusted by the ignition plug toward the turbine. An outer wall of the transition piece is cooled by compressed air supplied from the compressor so as to prevent the transition piece from being damaged by high-temperature combustion gas.

To this end, the transition piece has cooling holes through which the compressed air can be injected. Compressed air cools the inside of the transition piece through the cooling holes and then flows toward the combustor liner.

The compressed air that has cooled the transition piece may flow into an annular space of the combustor liner and may be provided as a cooling air from the outside of the flow sleeve through cooling holes provided in the flow sleeve to an outer wall of the combustor liner.

The high-temperature and high-pressure combustion gas ejected from the combustor 1200 is supplied to the turbine 1300. The supplied high-temperature and high-pressure combustion gas expands and applies impingement or reaction force to the turbine blades to generate rotational torque. A portion of the rotational torque is transmitted to the compressor 1100 via the torque tube, and the remaining portion which is the excessive torque is used to drive the generator or the like.

The turbine 1300 basically has a structure similar to that of the compressor 1100. That is, the turbine 1300 may include a plurality of turbine rotor disks 1320 similar to the compressor rotor disks 1120 of the compressor 1100. Each turbine rotor disk 1320 includes a plurality of turbine blades 1340 which are radially disposed. Each turbine blade 1340 may be coupled to the turbine rotor disk 1320 in a dovetail coupling manner. In addition, turbine vanes 1330 fixed to the housing are provided between the turbine blades 1340 of the turbine rotor disk 1320 to guide a flow direction of combustion gas passing through the turbine blades 1340.

Referring to FIG. 3, the turbine vanes 1330 are fixed in the housing by endwalls 200 coupled to inner ends and outer ends of the turbine vanes 1330. On the one hand, ring segments 300 are mounted to the inner surface of the housing at positions facing the outer ends of the turbine blades 1340, with a predetermined gap formed between each ring segment 300 and the outer ends of the corresponding turbine blades 1340.

Referring to FIG. 4, the turbine rotor disk 1320 has an approximately circular plate shape and includes a plurality of coupling slots 1322 formed in an outer circumferential surface thereof. Each of the coupling slots 1322 has a fir-tree-shaped corrugated surface.

The turbine blade 1340 is coupled to the coupling slot 1322 and includes, in an approximately central portion thereof, a platform part 1341 having a planar shape. The platform part 1341 has a side surface which comes into contact with a side surface of the platform part 1341 of an adjacent turbine blade to maintain an interval between the adjacent blades.

A root part 1342 is provided under a lower surface of the platform part 1341. The root part 1342 has an axial-type structure so that the root part 1342 is inserted into the coupling slot 1322 of the rotor disk 1320 along an axial direction of the rotor disk 1320.

The root part 1342 has an approximately fir-tree-shaped corrugated portion corresponding to the fir-tree-shaped corrugated surface formed in the coupling slot 1322. It is understood that the coupling structure of the root part 1342 is not limited to a fir-tree shape, and may be formed to have a dovetail structure.

A blade part 1343 is formed on an upper surface of the platform part 1341 to have an optimized shape according to specifications of the gas turbine. The blade part 1343 includes a leading edge which is disposed at an upstream side with respect to the flow direction of the combustion gas, and a trailing edge which is disposed at a downstream side.

The turbine blade 1340 comes into direct contact with high-temperature and high-pressure combustion gas. Because the combustion gas has a high temperature reaching 1700° C., a cooling unit is required. To this end, the gas turbine includes a cooling passage through which some of the compressed air is drawn out from some portions of the compressor and is supplied to the turbine blades.

The cooling passage may extend outside the housing (i.e., an external passage), or extend through the interior of the rotor disk (i.e., an internal passage), or both of the external passage and the internal passage may be used. A plurality of film cooling holes 1344 are formed in a surface of the blade part. The film cooling holes 1344 communicate with a cooling passage formed in the blade part 1343 to supply cooling air to the surface of the blade part 1343.

The blade part 1343 is rotated by combustion gas in the housing. A gap is formed between an end of the blade part 1343 and the inner surface of the housing so that the blade part 1343 can smoothly rotate. However, because the combustion gas may leak through the gap, a sealing unit is needed to prevent the leakage of combustion gas.

Each of the turbine blade and the turbine vane having an airfoil shape includes a leading edge, a trailing edge, a suction side, and a pressure side. An internal structure of the turbine blade and the turbine vane has a complex maze structure forming a cooling system. A cooling circuit in the turbine blade and the turbine vane receives cooling fluid, e.g., air, from the compressor, and the fluid passes through the ends of the turbine blade and the turbine vane. The cooling circuit includes a plurality of flow passages to maintain temperatures of all surfaces of the turbine blade and the turbine vane constant. At least some of fluid passing the cooling circuit is discharged through the leading edge, the trailing edge, the suction side, and the pressure side of the turbine vane.

In an impingement cooling circuit of the cooling circuit formed in each of the turbine blade and the turbine vane, an insert is provided in an internal chamber at a position spaced apart from a sidewall by a predetermined distance. Cooling fluid is drawn through a plurality of insert holes formed in the insert, thus cooling the inner surface of the sidewall. Cooling fluid, e.g., cooling air, which passes through the insert, is referred to as impingement jets. Cooling the inner surface of the sidewall by the impingement jets is referred to as impingement cooling.

Furthermore, the flow of impingement jets is divided into a gap flow of impingement jet which flows into a gap between the insert and the sidewall through the insert to cool the turbine vane and then flows toward a cut-back, and a flow of impingement jet which flows out of the turbine vane through a film hole of the sidewall to cool the sidewall. The cooling operation by these flows is referred to as a film cooling operation.

Here, air drawn into a first insert hole flows (i.e., gap-flows) in a cut-back and impinges air drawn into a second insert hole so that the flows of air are impeded by each other. This impediment in the flow of air may be exacerbated toward third and fourth insert holes. Therefore, there is a problem in that the cooling performance is markedly reduced toward a downstream side.

Figure 5:
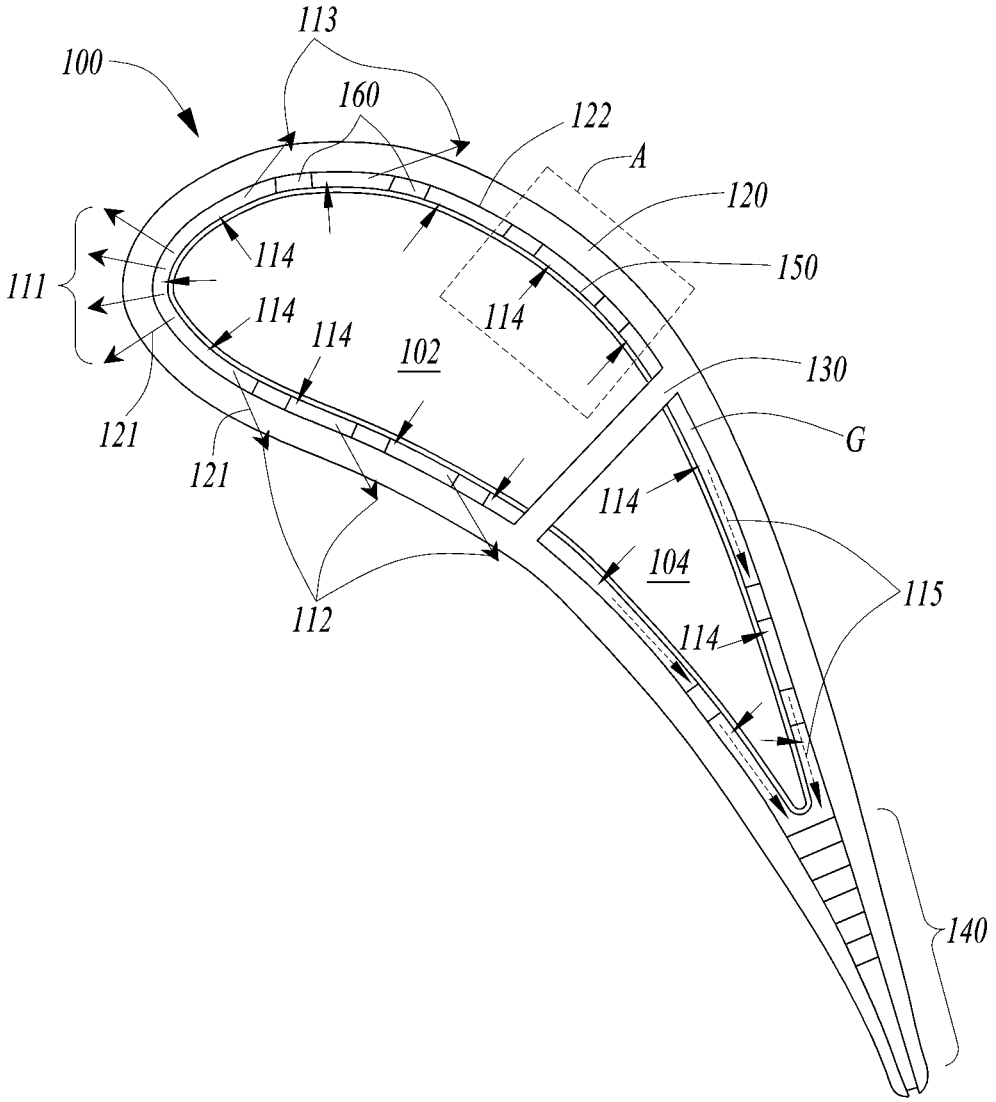
FIG. 5 is a sectional view illustrating a turbine vane in accordance with an exemplary embodiment.
Figure 6:
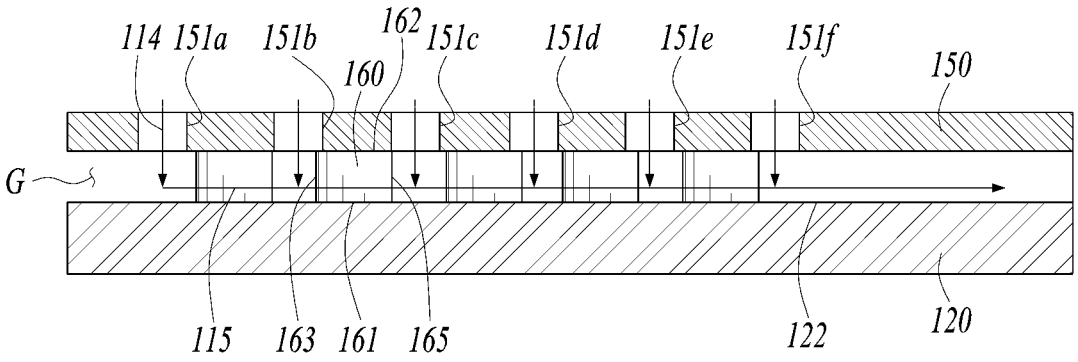
FIG. 6 is an enlarged sectional view illustrating portion A of FIG. 5 to show a flow and a direction of impingement jets and a gap flow.
Figure 7:
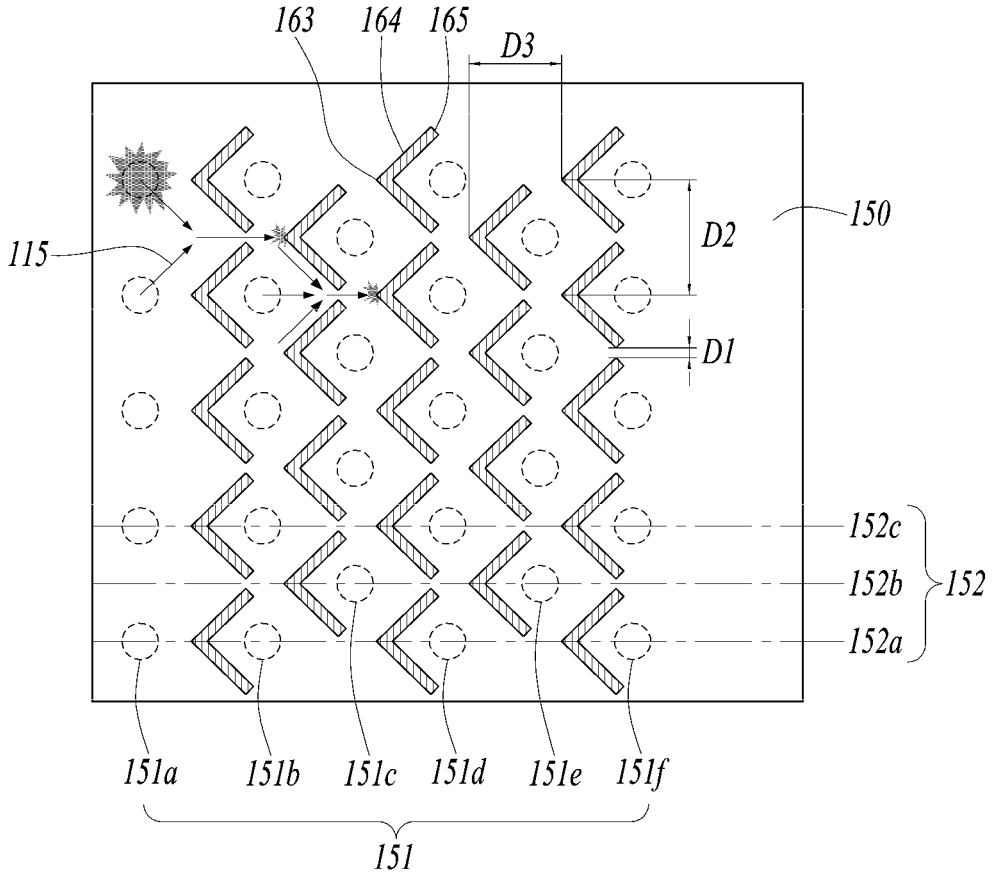
FIG. 7 is a sectional view illustrating a direction of a gap flow between a sidewall of a turbine vane and an insert in accordance with an exemplary embodiment.

FIG. 5 is a sectional view illustrating a turbine vane in accordance with an exemplary embodiment, FIG. 6 is an enlarged sectional view illustrating portion A of FIG. 5 to show the flow and direction of impingement jets and a gap flow, and FIG. 7 is a sectional view illustrating a direction of a gap flow between a sidewall of a turbine vane and an insert in accordance with an exemplary embodiment.

Referring to FIG. 5, the turbine vane 100 includes a sidewall 120 which has an airfoil shape including a leading edge and a trailing edge, a partition 130 which defines a path along which drawn cooling fluid flows, an insert 150 installed in the sidewall 120 at a position spaced apart from an inner surface 122 of the sidewall 120, and a plurality of guides 160 installed between the sidewall 120 and the insert 150.

Inclined toward the downstream side, a plurality of film holes 121 are penetrated through the sidewall 120. A cut-back 140 is formed on the trailing edge of the airfoil formed by the sidewall 120.

A space enclosed by the partition 130 and the sidewall 120 is divided into a first inflow chamber 102 adjacent to the leading edge and a second inflow chamber 104 adjacent to the trailing edge.

A plurality of insert holes 151 are formed in the insert 150 in a direction perpendicular to an inner surface of the sidewall 120 facing the inset holes 151.

Cooling fluid, i.e., cooling air, drawn through the first and second inflow chambers 102 and 104 is drawn into a gap G between the sidewall 120 and the insert 150 through the insert holes 151, thus cooling the sidewall 120.

Furthermore, cooling air drawn into the gap G directly cools the sidewall 120 while passing through the film holes 121. The cooling operation by this flow of air is referred to as a film cooling operation.

The plurality of film holes 121 may be formed at upstream sides of the leading edge, the pressure side, and the suction side of the sidewall 120. The plurality of film holes 121 form a first film cooling flow 111, a second film cooling flow 112, and a third film cooling flow 113.

Because the necessity of cooling varies by regions of the turbine blade or the turbine vane, a distance between the plurality of insert holes 151 may be changed depending on regions. For example, because the leading edge region in which an amount of first film cooling flow 111 is expressed as being largest comes into contact with highest-temperature air, the necessity of cooling is highest. Therefore, it is preferable that the distance between the film holes 121 is smallest.

Likewise, a larger number of insert holes 151 of the insert 150 through which corresponding fluid primarily passes may be distributed in the leading edge region.

Some of gap flows 115 that are formed in the gap G between the insert 150 and the sidewall 120 go out as film cooling flows 111, 112, and 113, and the other gap flows 115 go out toward the cut-back 140 and are discharged out of the cut-back 140.

For the gap flow 115, cooling fluid flows from the leading edge to the trailing edge. The plurality of insert holes 151 are disposed at positions spaced apart from each other at a predetermined interval from a region adjacent to the leading edge toward a region far therefrom. From the second insert hole based on the leading edge, a guide 160 is disposed at an upstream side immediately ahead of each insert hole 151.

Referring to FIG. 6, the impingement jets 114 are drawn into the gap G through the insert holes 151. The gap flow 115 that is drawn through a first insert hole 151*a* closest to the leading edge and flows toward the trailing edge after cooling the turbine blade or the turbine vane may come into contact with the guide 160 before coming into contact with an impingement jet drawn from a second insert hole 151*b*. Therefore, the impingement jet 114 and the gap flow 115 are mixed behind the guide 160 without impinging against each other.

Here, the guide 160 may guide cooling fluid drawn through the insert hole 151 such that the cooling fluid and a flow of cooling fluid drawn through a subsequent insert hole 151 do not interfere with each other.

The guide 160 may be formed to extend from the sidewall 120 and come into contact with the surface of the insert 150. That is, a first end 161 of the guide 160 is coupled to the sidewall 120 and a second end 162 thereof is coupled to the insert 150 so that heat may be transferred from the insert 150 to the sidewall 120 and dissipated to the outside. Furthermore, heat transferred by impingement of cooling fluid flowing through the gap G against the guide 160 may be transferred to the outside by conduction.

The plurality of insert holes 151 are arranged to form a plurality of rows and columns. For example, insert holes 151 of each column are disposed to alternate with insert holes 151 of an adjacent column.

Referring to FIG. 7, the lowermost row on which a plurality of insert holes 151 are arranged may be referred to as a first row, and a row above the lowermost row may be referred to as a second row. Furthermore, the leftmost column may be referred to as a first column, and a column disposed on the right side thereof may be referred to as a second column. Therefore, the insert holes 151 arranged in each column from the left side may be referred to as a first insert hole 151*a*, a second insert hole 151*b*, a third insert hole 151*c*, a fourth insert hole 151*d*, a fifth insert hole 151*e*, and a sixth insert hole 151*f*. The plurality of rows 152 may be referred to as a first row 152*a*, a second row 152*b*, a third row 152*c*, etc., from the lowermost side row.

For example, the first insert hole 151*a* and the second insert hole 151*b* are equally disposed on the first row 152*a*, the third insert hole 151*c* is disposed on the second row 152*b* at a position alternating with the second insert hole 151*b*, and the fourth insert hole 151*d* may be disposed on the first row 152*a* alternating with the third insert hole 151*c*.

A plurality of guides 160 are disposed between the plurality of insert holes 151. From the second insert holes 151*b*, the plurality of guides 160 may be located at an upstream side immediately ahead of the corresponding insert holes 151.

As illustrated in FIG. 7, if six columns of insert holes 151 are arranged, five columns of guides 160 are arranged.

Each of the guides 160 may include an upstream end 163 disposed at an upstream side of the gap flow 115, a pair of sidewalls 164 disposed to enclose an upstream side part of the insert hole 151, and downstream ends 165 disposed on the respective sidewalls 164 at the left and right sides of the gap flow direction of the insert hole 151.

Each of the sidewalls 164 may have a rectangular plate shape. An upstream apex at which the pair of sidewalls 164 come into contact with each other forms the upstream end 163 and a downstream side end of each sidewall 164 forms the corresponding downstream end 165.

The guides 160 may be arranged such that a distance D1 between a downstream end 165 of each guide 160 of each row and a downstream end 165 of the corresponding guide 160 of a subsequent row may be ⅓ to 3 times a diameter of the insert hole 151.

In other words, the guides 160 may be arranged such that a gap between outer edges of adjacent downstream ends 165 of two adjacent guides 160 is ⅓ to 3 times the inner diameter of the insert hole 151. Preferably, a length of the gap between the two guides may be approximately half of the diameter of the insert hole.

If the distance D1 between the downstream ends of the two guides 160 is less than ⅓ of the diameter of the insert hole 151, the production is difficult. If the distance D1 is greater than three times the diameter of the insert hole 151, a guide effect of collecting cooling air after impinging against the guides 160 is reduced, whereby the cooling effect in the gap flow direction is reduced.

Further, the guides 160 may be arranged such that a distance D2 between an upstream end 163 of each guide 160 of each row and an upstream end 163 of the corresponding guide 160 of a subsequent row may be 3 to 10 times the diameter of the insert hole 151.

Further, the guides 160 may be arranged such that a gap-flow-directional distance D3 between an upstream end 163 of each guide 160 of each column and an upstream end 163 of the corresponding guide 160 of a subsequent column may be 3 to 10 times the diameter of the insert hole 151.

Preferably, the guides 160 may be arranged such that the distance D3 between the upstream end 163 of each column and the upstream end 163 of a subsequent column may be approximately four times the diameter of the insert hole 151.

If the distance D2 and the distance D3 are less than three times the diameter of the insert hole 151, a space in which the plurality of guides 160 are arranged is excessively reduced. If the distance D2 and the distance D3 are greater than ten times the diameter of the insert hole 151, the number of insert holes 151 for impingement cooling per unit area is reduced, and cooling may not be satisfactorily performed.

Cooling air drawn through the first insert hole 151*a* impinges against the sidewall 120 and then flows toward the downstream side. Thereafter, the cooling air impinges against the upstream end 163 of the guide 160 so that the gap flow 115 is divided. Subsequently, the cooling air is guided along the sidewall 164 of the guide 160 and then guided into a gap defined between the two downstream ends 165 of the guide 160. Thereafter, the cooling air impinges against the upstream end of the guide 160 disposed in a subsequent column.

Cooling air drawn through the second insert hole 151*b* disposed directly next to the guide 160 may not interfere with the cooling air guide through the gap between the two downstream ends 165 of the guide 160 and may directly flow into the gap between the two following downstream ends 165 of the guide 160.

As such, the guides 160 for blocking, dividing, and guiding gap flows are disposed directly ahead of the insert holes 151 so that gap flow fluid and impingement cooling fluid may be prevented from interfering with each other.

Figure 8A:
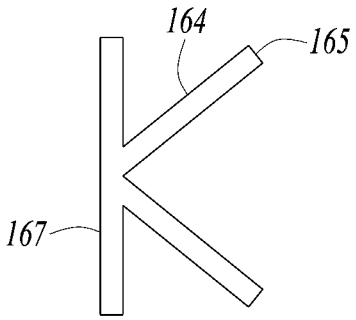
FIGS. 8A to 8C are sectional views illustrating one or more exemplary embodiments of a guide.
Figure 8B:
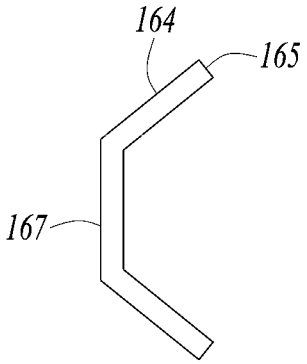
Figure 8C:
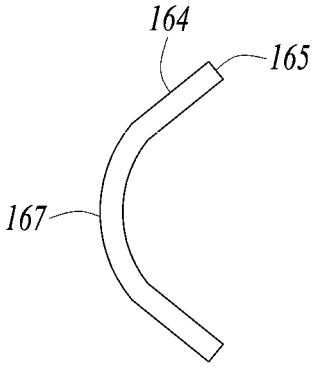

FIGS. 8A, 8B, and 8C are sectional views illustrating one or more exemplary embodiments of the guide 160.

Referring to FIG. 8A, the guide 160 may further include an impingement part 167 which is integrally coupled to the upstream end 163 and disposed in a direction perpendicular to the direction of the gap flow 115. The impingement part 167 may have a flat plate shape or a convex curved plate shape. Thus, the guide 160 may have an overall "K"-shaped cross-section.

Referring to FIGS. 8B and 8C, the guide 160 may include an upstream impingement part 167 which is disposed at the upstream side of the gap flow 115 so that cooling fluid impinges against the upstream impingement part 167, a pair of sidewalls 164 which extend from upper and lower ends of the upstream impingement part 167 in left and right diagonal directions with respect to the direction of the gap flow 115 of the insert hole 151 and enclose an upstream side part of the insert hole 151, and downstream parts 165 which are disposed on the respective sidewalls 164 on the left and right sides of the insert holes 151 relative to the gap flow direction.

In FIG. 8B, the upstream impingement part 167 may have a planar shape.

In FIG. 8C, the upstream impingement part 167 may have a curved shape which is convex toward an upstream side of the gap flow 115.

The impingement part or the upstream impingement part 167 may increase a surface area with which gap flow fluid impinges against the guide 160, thus promoting heat dissipation by heat conduction of the guide 160.

FIGS. 9A to 9D are perspective views illustrating one or more exemplary embodiments of the guide 160.

In the guide 160, a height of the upstream impingement part 167 is greater than that of the pair of sidewalls 164. In other words, the height of the upstream impingement part 167 may be 1.5 to 3 times the height of the pair of sidewalls 164.

Figure 9A:
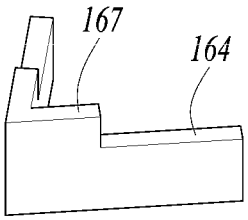
FIGS. 9A to 9D are perspective views illustrating another exemplary embodiments of the guide.

Referring to FIG. 9A, for the guide 160 illustrated in FIG. 8A, the upstream impingement part 167 may have a height to come into contact with the insert 150, and the height of the pair of sidewalls 164 may be approximately half of the height of the upstream impingement part 167.

Figure 9B:
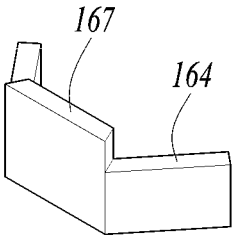

Referring to FIG. 9B, for the guide 160 illustrated in FIG. 8B, the upstream impingement part 167 having a planar shape may have a relatively high height, and the pair of sidewalls 164 may have a relatively low height which is approximately half of the height of the upstream impingement part 167.

Figure 9C:
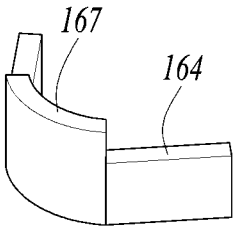

Referring to FIG. 9C, for the guide 160 illustrated in FIG. 8C, the upstream impingement part 167 having a curved shape which is convex toward the upstream side of the gap flow may have a relatively high height, and the pair of sidewalls 164 may have a relatively low height which is approximately half of the height of the upstream impingement part 167.

Figure 9D:
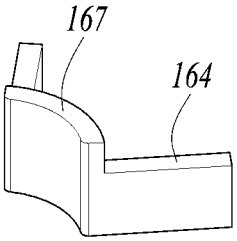

Referring to FIG. 9D, the upstream impingement part 167 having a curved shape which is concave toward the upstream side of the gap flow may have a relatively high height, and the pair of sidewalls 164 may have a relatively low height which is approximately half of the height of the upstream impingement part 167.

If the upstream impingement part 167 and the pair of sidewalls 164 of the guide 160 have a relatively high height to come into contact with the insert 150, cooling air may be excessively reduced in pressure after impinging against the guide 160, whereby the flow of cooling air may not be smooth. Therefore, the pair of sidewalls 164 are formed to have a relatively low height while the upstream impingement part 167 is formed to have a relatively high height so that excessive pressure reduction in the flow of cooling air may be prevented.

Figure 10:
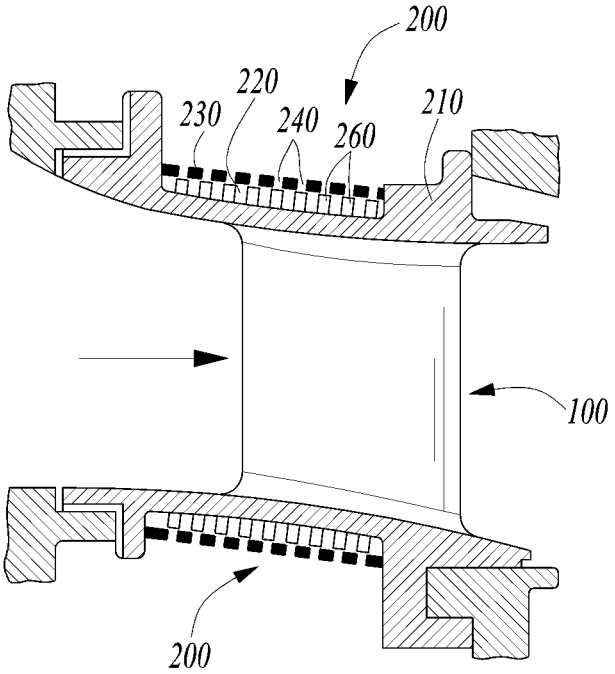
FIG. 10 is a sectional view illustrating a turbine vane and an endwall in accordance with an exemplary embodiment.

FIG. 10 is a sectional view illustrating a turbine vane and an endwall in accordance with an exemplary embodiment.

Referring to FIG. 10, endwalls 200 are respectively coupled to an inner end and an outer end of the turbine vane 100. The endwall 200 that is coupled to the outer end of the turbine vane 100 is fixed to the inner circumferential surface of the turbine casing.

A plurality of endwalls 200 are circumferentially arranged for a plurality of turbine vanes 100.

A space through which combustion gas flows is formed between body parts 210 of the endwalls 200.

A concave part 220 is formed in the body part 210 of the endwall 200 at a side opposite to the turbine vane 100.

A thin plate 230 having a plurality of cooling holes 240 is provided in the concave part 220 with a gap formed between the thin plate 230 and a bottom surface of the concave part 220. The thin plate 230 may be welded to opposite side surfaces of the concave part 220.

A plurality of guides 260 extending from the bottom surface of the concave part 220 to guide the flow of cooling fluid through gaps are provided in the concave part 220. Air drawn through the cooling holes 240 may impinge against the bottom surface of the concave part 220 and then flow in a normal direction relative to the surface of FIG. 10, thus cooling the endwall 200.

The guide 260 may guide cooling fluid drawn through a cooling hole 240 such that the cooling fluid and a flow of cooling fluid drawn through a subsequent cooling hole 240 do not interfere with each other.

The above-described exemplary embodiments related to the arrangement and shape of the guide 160 for guiding impingement cooling flows between the insert inserted into the turbine vane 100 and the sidewalls of the turbine vane 100 may be applied to the guide 260 of the endwall 200. Therefore, detailed description of various embodiments of the endwall 200 including the guide 260 will be omitted.

Figure 11:
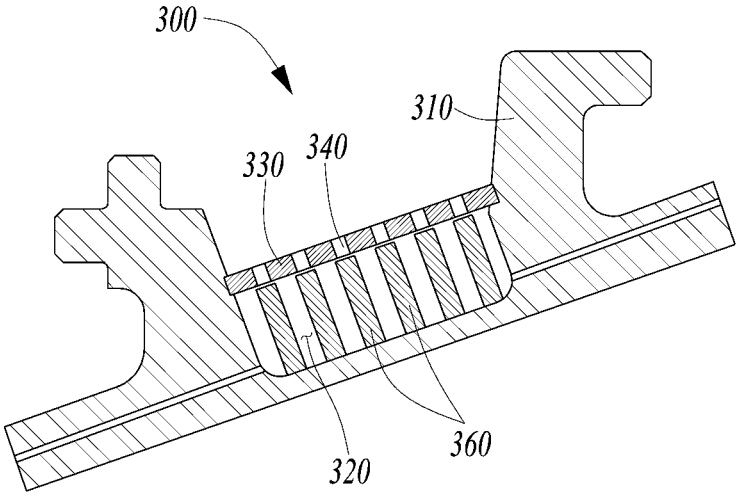
FIG. 11 is a sectional view illustrating a ring segment in accordance with an exemplary embodiment.

FIG. 11 is a sectional view illustrating a ring segment in accordance with an exemplary embodiment.

The ring segment 300 is fixed to the inner surface of the turbine housing at a position facing the outer end of the turbine blade 1340 which rotates in the turbine housing.

Referring to FIG. 11, body parts 310 of the ring segments 300 are circumferentially successively arranged to be separable from each other and are mounted to the inner circumferential surface of the turbine housing to enclose the plurality of turbine blades 1340.

A concave part 320 is formed in the body part 310 of the ring segment 300 at a side opposite to the turbine blade.

A thin plate 330 having a plurality of cooling holes 340 is provided in the concave part 320 with a gap formed between the thin plate 330 and a bottom surface of the concave part 320. The thin plate 330 may be welded to opposite side surfaces of the concave part 320.

A plurality of guides 360 extending from the bottom surface of the concave part 320 to guide the flow of cooling fluid through gaps are provided in the concave part 320. Air drawn through the cooling holes 340 may impinge against the bottom surface of the concave part 320 and then flow in a normal direction relative to the surface of FIG. 11, thus cooling the ring segment 300.

The guide 360 may guide cooling fluid drawn through a cooling hole 340 such that the cooling fluid and a flow of cooling fluid drawn through a subsequent cooling hole 340 do not interfere with each other.

The above-described exemplary embodiments related to the arrangement and shape of the guide 160 for guiding impingement cooling flows between the insert inserted into the turbine vane 100 and the sidewalls of the turbine vane 100 may be directly applied to the guide 360 of the ring segment 300. Therefore, detailed description of various embodiments of the ring segment 300 including the guide 360 will be omitted.

A turbine vane or a turbine ring segment in accordance an exemplary embodiment may include a guide structure capable of preventing a gap flow flowing in a gap between a sidewall and an insert or between a concave part and a thin plate and an impingement jet drawn through an insert hole or a cooling hole from interfering with each other. Therefore, the cooling performance may be enhanced.

While one or more exemplary embodiments have been described with reference to the accompanying drawings, it is to be understood by those skilled in the art that various modifications and changes in form and details can be made therein without departing from the spirit and scope as defined by the appended claims. Therefore, the description of the exemplary embodiments should be construed in a descriptive sense only and not to limit the scope of the claims, and many alternatives, modifications, and variations will be apparent to those skilled in the art.

What is claimed is:

1. A turbine vane comprising:

a sidewall configured to form an airfoil including a leading edge and a trailing edge;

an insert configured to be inserted inside the sidewall such that a gap is formed between the insert and an inner surface of the sidewall and includes a plurality of insert holes; and a plurality of guides extending from the sidewall and configured to guide a flow of cooling fluid through the gap, wherein the plurality of guides guide cooling fluid drawn through the insert holes to prevent the cooling fluid from interfering with a flow of cooling fluid drawn through a subsequent insert hole, wherein the plurality of guides contact with a surface of the insert, wherein the plurality of insert of the columns are arranged to alternate with the insert holes of a subsequent column, and wherein each of the plurality of guides comprises:

an upstream end disposed at an upstream side of a gap flow;

a pair of sidewalls disposed to enclose an upstream side part of the insert hole; and downstream ends disposed on respective sidewalls at left and right sides of the insert hole with respect to a gap flow direction.

2. The turbine vane according to claim 1, wherein the plurality of guides are arranged such that a distance between a downstream end of a guide on each of the rows and a downstream end of a guide on a subsequent row is ⅓ to 3 times a diameter of the insert hole.

3. The turbine vane according to claim 2, wherein the plurality of guides are arranged such that a distance between an upstream end of a guide on each of the columns and an upstream end of a guide on a subsequent column with respect to the gap flow direction is 3 to 10 times the diameter of the insert hole.

4. The turbine vane according to claim 1, wherein the guide further includes an impingement part integrally coupled to the upstream end and disposed perpendicular to the gap flow direction.

5. The turbine vane according to claim 1, wherein each of the plurality of guides comprises:

an upstream impingement part disposed at an upstream side of a gap flow so that cooling fluid impinges against the upstream impingement part;

a pair of sidewalls extending from upper and lower ends of the upstream impingement part in left and right diagonal directions relative to a gap flow direction of the insert hole and disposed to enclose an upstream side part of the insert hole; and downstream ends disposed on respective sidewalls at left and right sides of the insert hole with respect to a gap flow direction.

6. The turbine vane according to claim 5, wherein the upstream impingement part has a planar shape.

7. The turbine vane according to claim 5, wherein the upstream impingement part has a convex or concave curved shape toward an upstream side of the gap flow.

8. The turbine vane according to claim 5, wherein a height of the upstream impingement part is 1.5 to 3 times a height of a pair of sidewalls.

9. A turbine vane comprising:

endwalls configured to be coupled to an inner end and an outer end of the turbine vane;

a concave part configured to be formed on a body part of the endwall at a side opposite to the turbine vane and include a plurality of cooling holes;

a thin plate configured to be coupled to the concave part such that a gap is formed between a thin plate and a bottom surface of the concave part; and a plurality of guides extending from the bottom surface of the concave part and configured to guide a flow of cooling fluid through the gap, wherein the plurality of guides guide cooling fluid drawn through the cooling holes to prevent the cooling fluid from interfering with a flow of cooling fluid drawn through a subsequent cooling hole, wherein the plurality of cooling holes are arranged to form a plurality of rows and columns, wherein cooling holes of each of the columns are arrange to alternate cooling holes of a subsequent column, and wherein each of the plurality of guides comprises:

an upstream impingement part disposed at an upstream side of the gap flow so that cooling fluid impinges against the upstream impingement part;

a pair of sidewalls extending from upper and lower ends of the upstream impingement part in left and right diagonal directions relative to a gap flow direction of the insert hole and disposed to enclose an upstream side part of the insert hole; and downstream ends disposed on respective sidewalls at left and right sides of the insert hole with respect to a gap flow direction.

10. The turbine vane according to claim 9, wherein the plurality of guides are arranged such that a distance between a downstream end of a guide on each of the rows and a downstream end of a guide on a subsequent row is ⅓ to 3 times a diameter of the insert hole.

11. The turbine vane according to claim 10, wherein a height of the upstream impingement part is 1.5 to 3 times a height of a pair of sidewalls.

12. A ring segment comprising:

a ring segment body disposed to enclose a turbine blade and mounted to an inner circumferential surface of a turbine casing;

a concave part configured to be formed in the ring segment body at a side opposite to the turbine blade and include a plurality of cooling holes;

a thin plate configured to be coupled to a concave part such that a gap is formed between the thin plate and a bottom surface of the concave part; and a plurality of guides extending from the bottom surface of the concave part and configured to guide a flow of cooling fluid through the gap, wherein the plurality of guides guide cooling fluid drawn through the cooling holes to prevent the cooling fluid from interfering with a flow of cooling fluid drawn through a subsequent cooling hole;

wherein the plurality of cooling holes are arranged to form a plurality of rows and columns, and cooling holes of each of the columns are arranged to alternate with cooling holes of a subsequent column, and wherein each of the plurality of guides comprises:

an upstream impingement part disposed at an upstream side of a gap flow so that cooling fluid impinges against the upstream impingement part;

a pair of sidewalls extending from upper and lower ends of the upstream impingement part in left and right diagonal directions relative to a gap flow direction of the insert hole and disposed the enclose an upstream side part of the insert hole; and downstream ends disposed on a respective sidewalls at left and light sides of the insert hole with respect to the gap flow direction.

13. The ring segment according to claim 12, wherein the plurality of guides are arranged such that a distance between a downstream end of a guide on each of the rows and a downstream end of a guide on a subsequent row is ⅓ to 3 times a diameter of the insert hole.

14. The ling segment according to claim 12, wherein a height of the upstream impingement part is 1.5 to 3 times a height of a pair of sidewalls.

* * * * *